US009896895B2

(12) United States Patent
Richards et al.

(10) Patent No.: US 9,896,895 B2
(45) Date of Patent: Feb. 20, 2018

(54) ANNULUS PRESSURE RELEASE RUNNING TOOL

(71) Applicant: Halliburton Energy Services, Inc., Houston, TX (US)

(72) Inventors: William Mark Richards, Flower Mound, TX (US); Eddie Eddieberto Perez, Wylie, TX (US); Bryon David Mullen, Carrollton, TX (US); Christopher Robert Delzell, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 119 days.

(21) Appl. No.: 14/906,841

(22) PCT Filed: Jun. 30, 2015

(86) PCT No.: PCT/US2015/038502

§ 371 (c)(1),
(2) Date: Jan. 21, 2016

(87) PCT Pub. No.: WO2017/003446

PCT Pub. Date: Jan. 5, 2017

(65) Prior Publication Data

US 2017/0226817 A1 Aug. 10, 2017

(51) Int. Cl.
*E21B 23/04* (2006.01)
*E21B 17/02* (2006.01)
(Continued)

(52) U.S. Cl.
CPC ..... *E21B 23/04* (2013.01); *E21B 17/02* (2013.01); *E21B 23/06* (2013.01); *E21B 33/12* (2013.01); *E21B 43/10* (2013.01)

(58) Field of Classification Search
CPC ..... E21B 17/02; E21B 17/06; E21B 23/04
See application file for complete search history.

(56) References Cited

U.S. PATENT DOCUMENTS 4,726,425 A 2/1988 Smith, Jr.
4,986,362 A 1/1991 Pleasants
(Continued)

OTHER PUBLICATIONS

International Search Report and Written Opinion for PCT/US2015/038502 dated Jan. 5, 2016.

*Primary Examiner* — David L Andrews
*Assistant Examiner* — Kristyn A Hall
(74) *Attorney, Agent, or Firm* — McDermott Will & Emery LLP

(57) ABSTRACT

A system includes a downhole tool assembly extendable within a wellbore. A running tool axially interposes the downhole tool assembly and the conveyance and includes an elongate body providing an interior and one or more radial protrusions. A connection sub is disposed about the body and provides a releasable connection engageable with the downhole tool assembly. A torque sleeve is disposed about the body and at least a portion of the connection sub. A connection sub piston interposes the body and the connection sub and is axially movable between a supported position, where the connection sub piston radially supports the connection sub, and an unsupported position, where at least a portion of the connection sub is radially unsupported by the connection sub piston. Increasing pressure within an annulus between the running tool and the wellbore moves the connection sub piston from the supported position to the unsupported position.

22 Claims, 9 Drawing Sheets

(51) Int. Cl.

| | |
|---|---|
| ***E21B 23/06*** | (2006.01) |
| *E21B 33/12* | (2006.01) |
| *E21B 43/10* | (2006.01) |

(56) References Cited

U.S. PATENT DOCUMENTS

| | | | |
|---|---|---|---|
| 5,404,955 | A | 4/1995 | Echols, III et al. |
| 5,695,009 | A | 12/1997 | Hipp |
| 5,794,694 | A | 8/1998 | Smith, Jr. |
| 2013/0264071 | A1 | 10/2013 | Noffke et al. |

ANNULUS PRESSURE RELEASE RUNNING TOOL

BACKGROUND

In completing production or injection wells in the oil and gas industry, it is common practice to run various downhole tools into the wellbore in a retracted or "run-in" position and then set or actuate the downhole tool once reaching a target destination. Such downhole tools are normally run into the wellbore on some type of running tool, which, in turn, is releasably connected, to the lower end of a tubing string conveyance extended from a surface location. After the downhole tool is set within the wellbore, the running tool is then released from the downhole tool and withdrawn from the wellbore along with the tubing string.

Some running tools incorporate the use of shearable elements (e.g., shear pins, shear rings, etc.) to protect against premature disconnection of the running tool from the downhole tool when the running tool is rotated in a direction that would normally disconnect the running tool from the well tool. Unfortunately, such shearable elements frequently undergo substantial wear before the downhole tool assembly reaches its target destination, which can result in premature shearing and, therefore, premature setting of the downhole tool or disconnection of the running tool. This possibility is especially present in the modern, long and heavy downhole tool assemblies required for completing long production intervals and in those downhole tool assemblies required to complete production intervals in horizontal or inclined wellbores where the forces exerted on any shearable elements during installation can be substantial.

One proposed solution for preventing the premature shearing of the shearable elements is to include additional or stronger shearable elements. However, as may be expected, for a shearable element to be strong enough to prevent premature shearing, the force required to deliberately shear the shearable element be more than can be developed through the tubing string on which the downhole tool assembly is carried. Further, there may be instances where the downhole tool assembly becomes stuck in the wellbore before it reaches its target destination. When this occurs, it is highly desirable to be able to release the running tool and recover it along with the tubing string from the wellbore without the need for first setting the downhole tool.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention relates generally to equipment utilized and operations performed in conjunction with a subterranean well and, more particularly, to a running tool that may be released from a downhole tool assembly using annulus pressure.

The embodiments disclosed herein provide a running tool capable of deploying downhole equipment and releasing the running tool using annular pressure. The running tool is designed to carry the downhole equipment while maintaining the entire assembly torque-locked. Once the downhole equipment has been delivered and set, the presently disclosed torque-lock feature can be released by increasing fluid pressure within the annulus defined between the running tool and a wall of a wellbore and subsequently applying a tensile load in the uphole direction, or by using a contingency release option activated by increasing the pressure within the running tool and subsequently rotating the running tool to unthread it from the downhole equipment.

Figure 1:
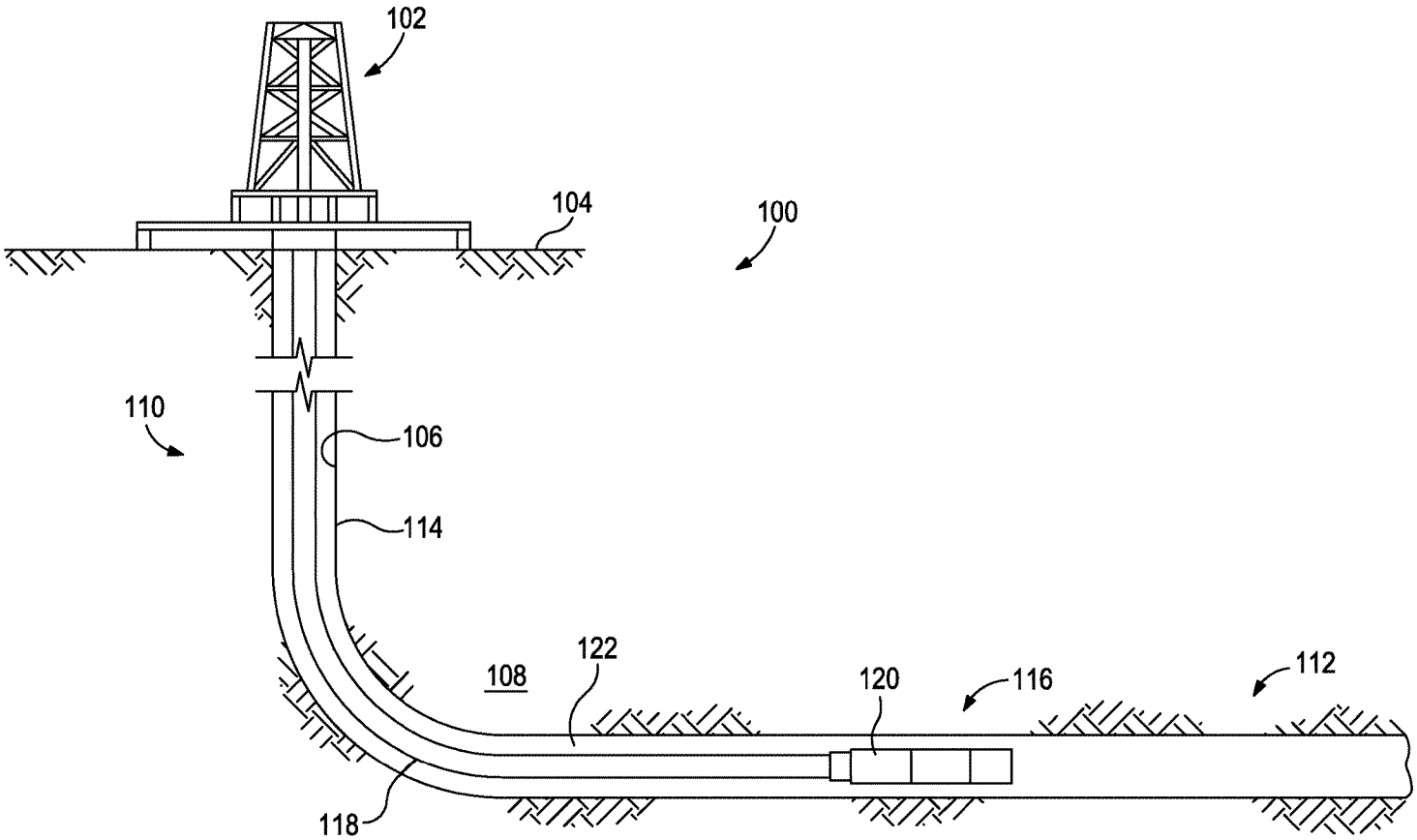
FIG. 1 is a well system that may embody or otherwise employ one or more principles of the present disclosure.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any sea-based or sub-sea application where the service rig 102 may be a floating platform, a semi-submersible platform, or a sub-surface wellhead installation as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a downhole tool or downhole tool assembly 116 that may be conveyed into the wellbore 106 on a conveyance 118 that extends from the service rig 102. The downhole tool assembly 116 may comprise a variety of tools or assemblies used in drilling or completing the wellbore 106 and may be intended to be set or actuated and subsequently left in the wellbore 106. Exemplary downhole tools or tool assemblies 116 include, but are not limited to, a completion string including one or more packers and associated well screens, one or more well screens, one or more wellbore packers, a wellbore packer test tool, a liner hanger, a polished bore receptacle, etc. The conveyance 118 that delivers the downhole tool assembly 116 into the wellbore 106 may be, but is not limited to, casing, coiled tubing, drill pipe, tubing, or the like.

The downhole tool assembly 116 may be conveyed downhole to a target location within the wellbore 106 and subsequently set at the target location. After being set within the wellbore 106, the downhole tool assembly 116 may be released from the conveyance 118 by operation of a running tool 120. As described in greater detail below, the running tool 120 may be designed to carry the downhole tool assembly 116 into the wellbore 106 while maintaining the entire downhole tool assembly 116 torque-locked. The torque-locked feature on the running tool 120 may be released by increasing fluid pressure within the conveyance 118, and the downhole tool assembly 116 may be subsequently released from the running tool 120 by increasing the fluid pressure within the annulus 122 defined between the conveyance 118 and the wellbore 106.

It will be appreciated by those skilled in the art that even though FIG. 1 depicts the downhole tool assembly 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2A:
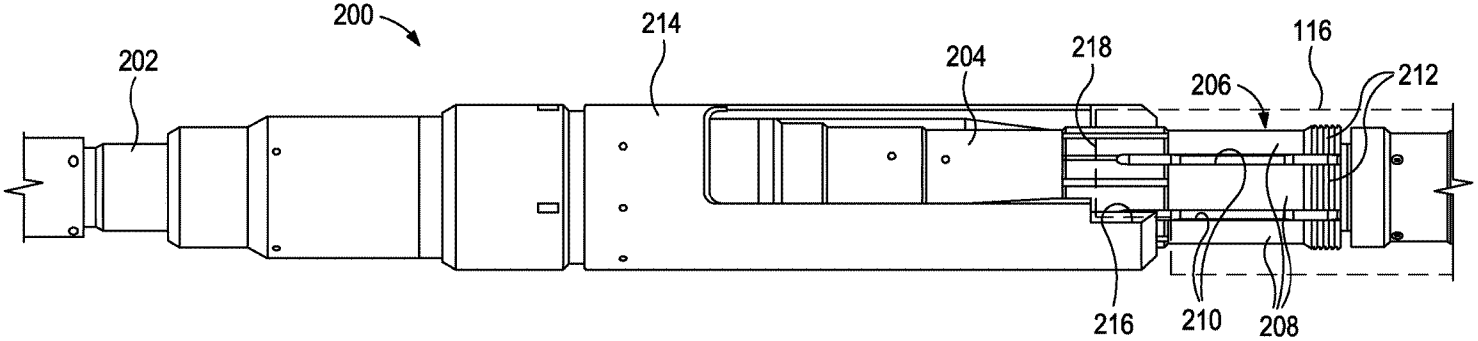
FIGS. 2A and 2B are side views of an exemplary running tool.
Figure 2B:
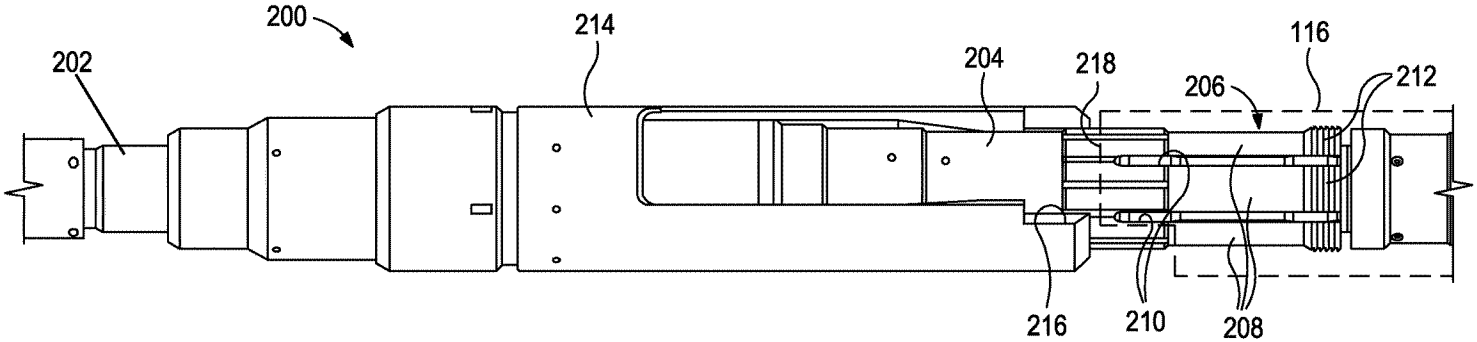

Referring now to FIGS. 2A and 2B, with continued reference to FIG. 1, illustrated are side views of an exemplary running tool 200, according to one or more embodiments of the present disclosure. More particularly, FIG. 2A depicts the running tool 200 in a torque-locked position, and FIG. 2B depicts the running tool 200 in a torque-released position. The running tool 200 may be the same as or similar to the running tool 120 of FIG. 1 and, therefore, may be used to run the downhole tool assembly 116 (shown in dashed outline) into the wellbore 106 and subsequently release the downhole tool assembly 116 at a target location.

As illustrated, the running tool 200 may include an elongate, cylindrical mandrel or body 202 and a connection sub 204 disposed about the body 202. The connection sub 204 may be configured to facilitate and provide a releasable connection or coupling engagement between the running tool 200 and the downhole tool assembly 116. In the illustrated embodiment, for example, the releasable connection of the connection sub 204 is depicted as a collet 206 disposed at the distal end of the connection sub 204 and used to couple the running tool 200 to the downhole tool assembly 116. In other embodiments, however, and as described in greater detail below, the collet 206 may be replaced with several different types of releasable connections that are equally suitable for coupling the running tool 200 to the downhole tool assembly, without departing from the scope of the disclosure. Accordingly, the following description of the collet 206 and its operation should not be considered as limiting the present disclosure to any one type of releasable connection for the connection sub 204.

In the illustrated embodiment, the collet 206 may define and otherwise provide a plurality of axially extending collet fingers 208 separated by axially extending slots 210 defined through the collet 206. The collet 206 may further define an engagement profile 212 at the ends of each collet finger 208. The engagement profile 212 may be configured to mate with a corresponding engagement profile (not shown) defined on the inner radial surface of the downhole tool assembly 116 to thereby couple the downhole tool assembly 116 to the collet 206 and, therefore, to the running tool 200. In some embodiments, as illustrated, the engagement profile may comprise radial grooves or helical threading configured to threadably engage corresponding threading (not shown) provided on the inner radial surface of the downhole tool assembly 116. In other embodiments, as discussed below, the engagement profile 212 may comprise non-helical grooves, dogs or other geometric features that may secure the downhole tool assembly 116 to the collet 206.

The running tool 200 may further include a torque sleeve 214 disposed about the body 202 and also disposed about at least a portion of the collet 206. The torque sleeve 214 may be configured to prevent the running tool 200 from prematurely rotating out of engagement with the downhole tool assembly 116, and also allows an operator to transmit torque to various components run downhole with the running tool 200, such as a completion string. As illustrated, the torque sleeve 214 may provide and otherwise define one or more arcuate cutouts 216 (one shown) at its distal end. The arcuate cutout(s) 216 may be configured to receive a corresponding one or more axial extensions 218 (one shown in dashed outline) extending from the uppermost sub (i.e., the top sub) of the downhole tool assembly 116. Accordingly, the arcuate cutout(s) 216 may be designed and otherwise configured to receive the axial extension(s) 218.

As described in greater detail below, the torque sleeve 214 may be configured to move axially with respect to the collet 206 as the running tool 200 transitions from the torque-locked position (FIG. 2A) to the torque-released position (FIG. 2B). In the torque-locked position, the axial extension(s) 218 is received within the arcuate cutout(s) 216 such that rotation of the running tool 200 correspondingly rotates the downhole tool assembly 116 as engaged at the arcuate cutout(s) 216. Upon transitioning to the torque-released position, however, the axial extension(s) 218 may become disengaged from the arcuate cutout(s) 216, and thereby allowing the running tool 200 to be rotated with respect to the downhole tool assembly 116. In some embodiments, once in the torque-released position, the running tool 200 may be detached from the downhole tool assembly 116 by rotating the running tool 200 to unthread the downhole tool assembly 116 from the engagement profile 212 (e.g., threading), such as by rotating the running tool 200 via the conveyance 118 (FIG. 1) from the surface 104 (FIG. 1). In other embodiments, however, as described in greater detail below, the running tool 200 may be released from the downhole tool assembly 116 by placing an axial load on the connection sub 204 in the uphole direction, which may release one or more lugs, disengage a bump profile, break one or more shear pins, or any combination thereof.

Figure 3A:
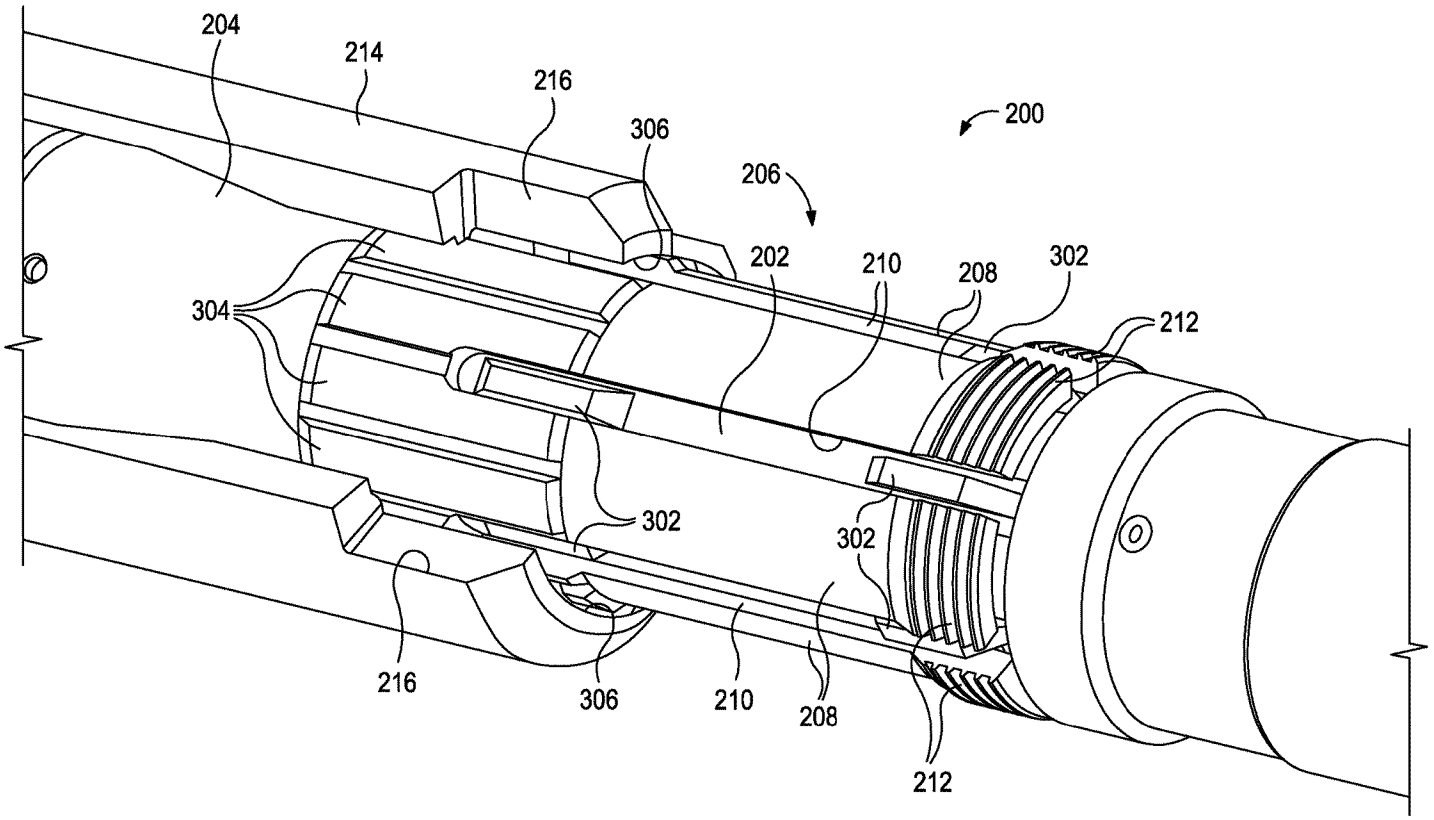
FIGS. 3A and 3B depict enlarged isometric views of a portion of the running tool of FIGS. 2A and 2B moving from the torque-locked position to the torque-released position.
Figure 3B:
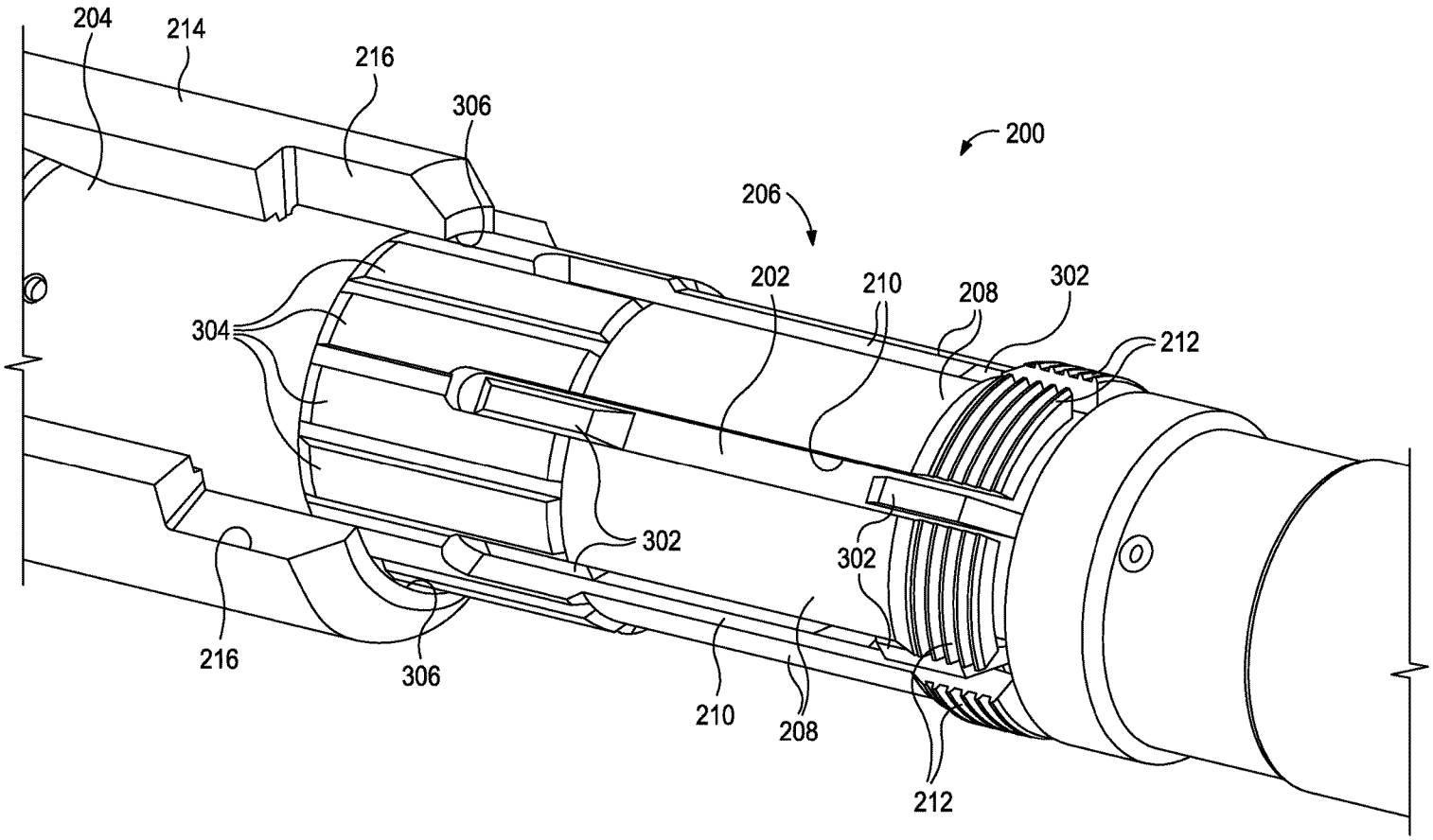

Referring to FIGS. 3A and 3B, with continued reference to FIGS. 2A and 2B, illustrated are enlarged isometric views of a portion of the running tool 200. More particularly, FIG. 3A depicts the torque sleeve 214 and the collet 206 arranged in the torque-locked position, and FIG. 3B depicts the torque sleeve 214 and the collet 206 arranged in the torque-released position. As illustrated, the body 202 may include at its distal end one or more radial protrusions 302 that extend radially outward from the outer surface of the body 202. The radial protrusions 302 may be sized and otherwise configured to extend into the slots 210 defined between the collet fingers 208 of the collet 206. The radial protrusions 302 may be configured to transmit torque from the body 202 to the connection sub 204, and thereby allowing the connection sub 204 to detach (e.g., unthread) from the downhole tool assembly 116.

The outer radial surface of the connection sub 204 may provide and otherwise define a plurality of splines 304 configured to engage and otherwise mate with a splined profile 306 defined on the inner radial surface of the torque sleeve 214. The splines 304 may comprise any radial protrusion or grooved interface configured to matingly engage the splined profile 306. Accordingly, the splines 304 and the splined profile 306 may be castellated, as shown, or may alternatively assume any polygonal design or configuration, without departing from the scope of the disclosure. In other embodiments, however, the connection sub 204 and the torque sleeve 214 may alternatively be engaged with keystock placed into corresponding grooves defined in each component part.

In the torque-locked position, as shown in FIG. 3A, the splines 304 are mated with the splined profile 306 and, therefore, torque may be transferred between the connection sub 204 and the torque sleeve 214. Moreover, as discussed above, when the running tool 200 is in the torque-locked position the axial extension 218 (FIGS. 2A-2B) may also be received within the arcuate cutout 216, thereby allowing torque to be transferred between the running tool 200 and the downhole tool assembly 116 (FIGS. 2A-2B).

In the torque-released position, however, as shown in FIG. 3B, the torque sleeve 214 is moved axially (e.g., uphole) with respect to the connection sub 204, thereby disengaging the axial extension 218 from the arcuate cutout 216 and allowing the running tool 200 to be rotated relative to the downhole tool assembly 116. In at least one embodiment, as mentioned above, rotating the running tool 200 relative to the downhole tool assembly 116 may detach the downhole tool assembly 116 from the running tool 200. More particularly, a torsional load may be applied to the body 202, such as from the conveyance 118 (FIG. 1), and transferred to the connection sub 204 via the radial protrusions 302 engaging the sidewalls of the slots 210 defined between the collet fingers 208. As the collet 206 rotates, the downhole tool assembly 116 may gradually unthread from the running tool 200 at the engagement profile 212 (e.g., threading). Once unthreaded and otherwise detached from the downhole tool assembly 116, the running tool 200 may be retracted back uphole as connected to the conveyance 118.

Figure 4A:
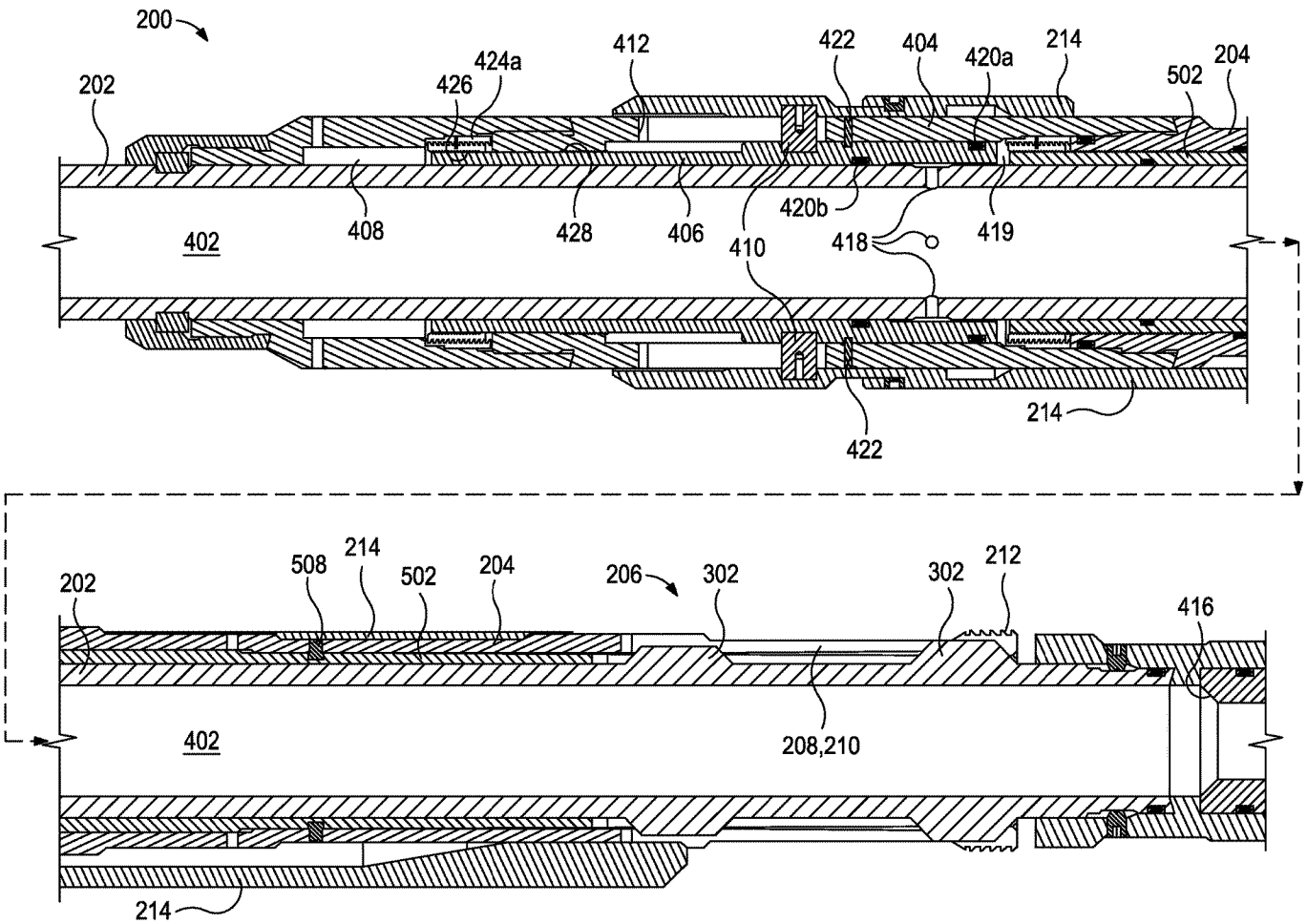
FIGS. 4A and 4B are cross-sectional side views of the running tool of FIGS. 2A and 2B depicting how the running tool may move from the torque-locked position to the torque-released position.
Figure 4B:
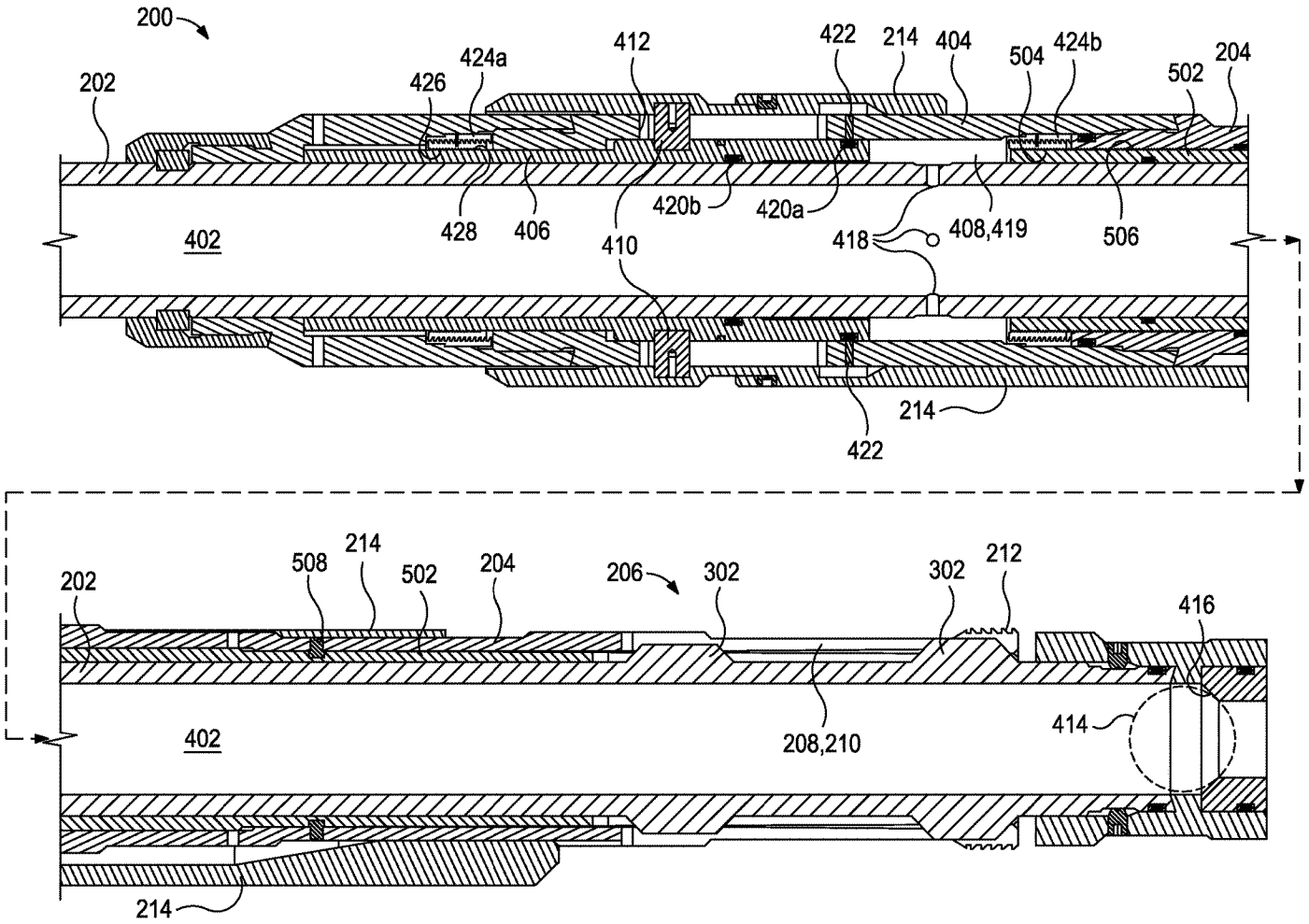

Referring now to FIGS. 4A and 4B, illustrated are cross-sectional side views of the running tool 200 depicting how the running tool 200 may move from the torque-locked position to the torque-released position, according to one or more embodiments. More particularly, FIG. 4A depicts the running tool 200 in the torque-locked position, and FIG. 4B depicts the running tool 200 in the torque-released position. As illustrated, the body 202 extends substantially the entire length of the running tool 200 and includes an interior 402 that may be in fluid communication with the conveyance 118 (FIG. 1) such that fluid pressure introduced into the conveyance 118 from a surface location (e.g., the earth's surface 104 of FIG. 1), for example, may be transmitted to the interior 402. The connection sub 204 is depicted as being positioned about the body 202, and the torque sleeve 214 is depicted as being positioned about the body 202 and at least partially about the connection sub 204, as generally described above.

As illustrated, the running tool 200 may further include a housing cylinder 404 and a piston 406. The housing cylinder 404 may be disposed about the body 202 and positioned at least partially beneath the torque sleeve 214. The piston 406 may interpose the body 202 and the housing cylinder 404 and may be axially movable with respect to the body 202 and the housing cylinder 404 within a piston chamber 408 cooperatively defined by the body 202 and the housing cylinder 404. The piston 406 may also be operatively coupled to the torque sleeve 214 such that axial movement of the piston 406 correspondingly moves the torque sleeve 214 in a similar axial direction. More particularly, one or more pins 410 (two shown) may extend between the torque sleeve 214 and the piston 406 and through a corresponding one or more axial slots 412 (two shown) defined in the housing cylinder 404. Accordingly, axial movement of the piston 406 within the piston chamber 408 correspondingly moves the torque sleeve 214 as the pins 410 translate within the axial slots 412.

To move the piston 406, and thereby move the running tool 200 from the torque-locked position (FIG. 4A) to the torque-released position (FIG. 4B), the fluid pressure within the interior 402 may be increased. In some embodiments, as illustrated in FIG. 4B, a wellbore projectile 414, such as a ball, a plug, or a dart, may be introduced into the conveyance 118 (FIG. 1) and pumped to the running tool 200 until locating and landing on a seat 416 provided and otherwise defined within the interior 402 of the body 202. Once landed on the seat 416, the wellbore projectile 414 may form a seal within the interior 402 that prevents fluid migration further downhole and past the axial location of the seat 416. As a result, with the wellbore projectile 414 properly landed on the seat 416, the fluid pressure within the interior 402 may be increased.

In other embodiments, however, the fluid pressure within the interior 402 may be increased by other means or methods, without departing from the scope of the disclosure. For example, a wellbore projectile may be landed on a seat or shoulder located further below the running tool 200 and thereby effectively preventing fluid migration further downhole and allowing fluid pressure within the interior of 402 to be increased. In yet other embodiments, a valve (not shown) may be located at a location downhole from the downhole tool 116 below the running tool 200. The valve may be run downhole in a closed position or otherwise closed prior to applying pressure.

Increasing the pressure within the interior 402 may correspondingly increase the pressure within a pressure cavity 419. More particularly, one or more pressure ports 418 (three shown) may be defined in the body 202 and facilitate fluid communication between the interior 402 and the pressure cavity 419, which may comprise a section of the piston chamber 408 located downhole from the piston 406. Opposing seals 420, such as O-rings or the like, may be positioned at the interface between the piston 406 and the housing cylinder 404 (i.e., seal 420*a*) and the interface between the piston 406 and the body 202 (i.e., seal 420*b*). The seals 420*a,b* may prevent fluid migration past the interfaces and, more importantly, may allow the pressure cavity 419 to be pressurized via the pressure ports 418.

The piston 406 may be coupled to the housing cylinder 404 with one or more shearable devices 422 (two shown), such as shear pins, shear screws, or other similar shearing devices, and the shearable devices 422 may be configured to shear and otherwise fail upon assuming a predetermined axial load. Once the shearable devices 422 fail, the piston 406 may be free from engagement with the housing cylinder 404 and, therefore, free to move axially within the piston chamber 408.

With reference to FIG. 4B, the wellbore projectile 414 is shown as having landed on the seat 416, at which point the pressure within the interior 402 may be increased. Increasing the pressure within the interior 402 may correspondingly increase the pressure within the pressure cavity 419 via the pressure ports 418, and an increased pressure within the pressure cavity 419 may result in an axial load being applied on the piston 406 in the uphole direction (i.e., to the left in FIGS. 4A and 4B). Further increasing the fluid pressure may correspondingly increase the axial load assumed by the piston 406 until the predetermined axial load of the shearable devices 422 is met or exceeded, at which point the shearable devices 422 may fail and the piston 406 may then be free from engagement with the housing cylinder 404 and, therefore, may be free to move axially uphole within the piston chamber 408. As the piston 406 moves axially uphole, the torque sleeve 214 may correspondingly move in the same direction as coupled to the piston 406 via the pins 410, and thereby transitioning the running tool 200 to the torque-released position.

The running tool 200 may further include an upper locking mechanism 424*a* disposed between the piston 406 and the cylinder housing 404. The upper locking mechanism 424*a* may be configured to secure the piston 406 in the torque-released position. In at least one embodiment, the upper locking mechanism 424*a* may comprise a body lock ring that includes a plurality of ramped teeth 426 defined on its inner radial surface. The piston 406 may likewise define a plurality of ramped teeth 428 on its outer radial surface, and the ramped teeth 428 may be configured to engage the ramped teeth 426 of the upper locking mechanism 424*a*. As the piston 406 moves uphole within the piston chamber 408, as described above, the ramped teeth 426, 428 may come into contact with each other. The ramped teeth 426, 428 may be angled such that movement of the piston 406 in the uphole direction is allowed and otherwise ratchets the piston 406 in the uphole direction. The ramped teeth 426, 428, however, may further be angled such that movement of the piston 406 in the downhole direction is substantially prevented. Accordingly, once the running tool 200 moves to the torque-released position, as shown in FIG. 4B, transitioning back to the torque-locked position is prohibited.

As indicated above, once the running tool 200 is in the torque-released position, as shown in FIGS. 2B, 3B, and 4B, the running tool 200 may be detached from the downhole tool assembly 200. In the illustrated embodiment, for example, the running tool 200 may be rotated with respect to the downhole tool assembly 116 (FIGS. 2A-2B) to thereby unthread the downhole tool assembly 116 from the running tool 200. Once the downhole tool assembly 116 is unthreaded or otherwise detached from the running tool 200, the running tool 200 may then be retracted to the surface 104 (FIG. 1) as attached to the conveyance 118 (FIGS. 2A-2B). In some embodiments, however, the preceding method of unthreading the running tool 200 from the downhole tool assembly 116 may comprise a contingency or secondary method of detaching the running tool 200 from the downhole tool assembly 116. According to the present disclosure, the running tool 200 may be alternatively detached from the downhole tool assembly 116 by increasing the fluid pressure on the exterior of the running tool 200 and, more particularly, within the annulus 122 (FIG. 1) defined between the running tool 200 and a wall of the wellbore 106 (FIG. 1). This process is described below in conjunction with FIG. 5.

Figure 5:
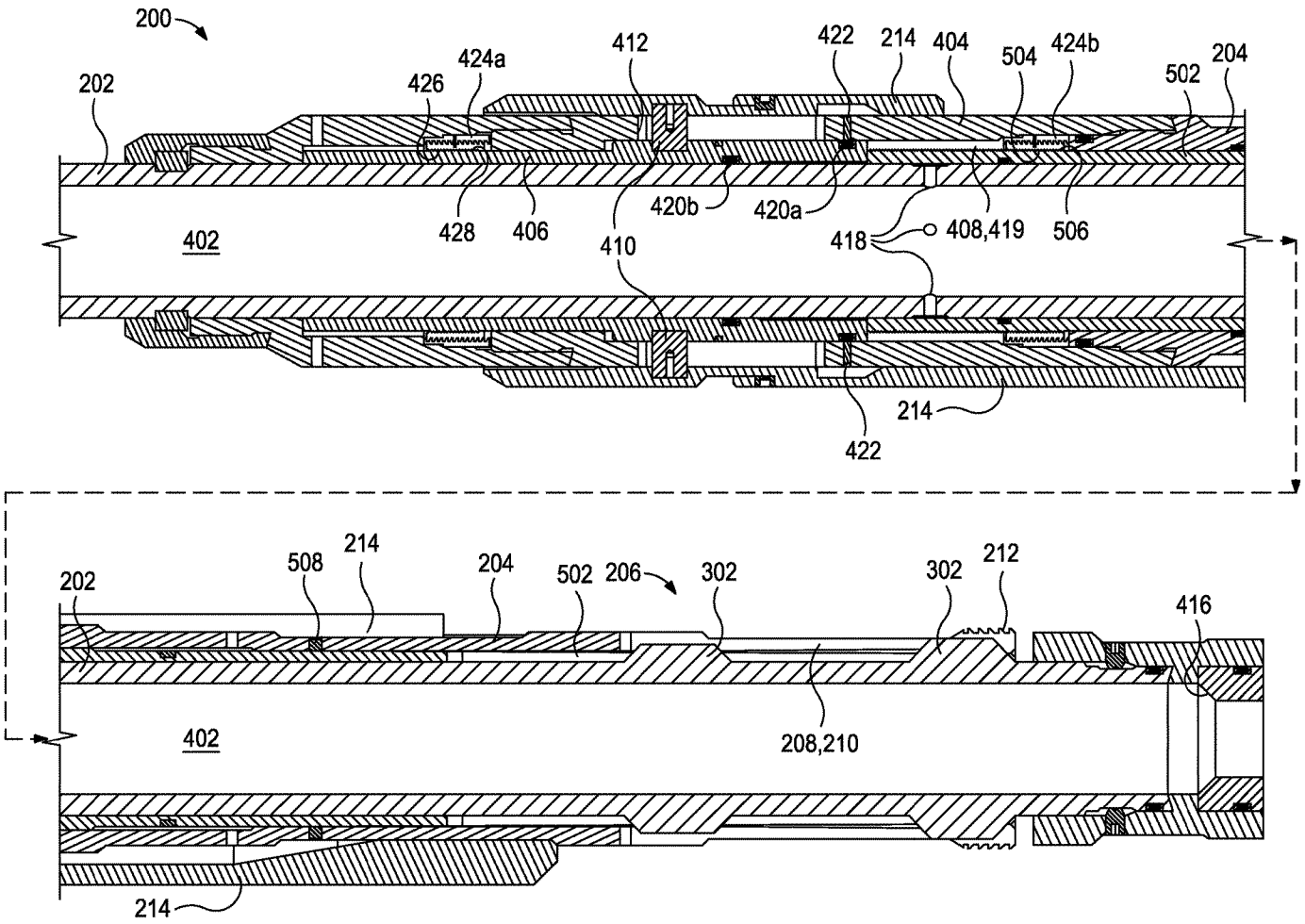
FIG. 5 is another cross-sectional side view of the running tool of FIGS. 2A and 2B.

Referring now to FIG. 5, with continued reference to the prior figures, illustrated is another cross-sectional side view of the running tool 200, according to one or more embodiments. As illustrated, the running tool 200 may further include a connection sub piston 502 disposed about the body 202 and interposing the body 202 and the connection sub 204. The connection sub piston 502 may be configured to radially support the connection sub 204 and may be axially movable between a supported position, where the connection sub piston 502 radially supports the collet fingers 208, for example, and an unsupported position, where the connection sub piston 502 is moved axially so that at least a portion of the collet fingers 208 is no longer radially supported. FIGS. 4A and 4B depict the connection sub piston 502 in the supported position, and FIG. 5 shows the connection sub piston 502 after having transitioned to the unsupported position.

The running tool 200 may further include a lower locking mechanism 424*b* disposed and otherwise arranged between the connection sub piston 502 and the cylinder housing 404. The lower locking mechanism 424*b* may be configured to secure the connection sub piston 502 against axial movement in the downhole direction (i.e., away from the piston 406) in both the supported and unsupported positions. More specifically, and with reference again to FIG. 4B, increasing the pressure within the interior 204 and, therefore, within the pressure cavity 419 may not only place an axial load on the piston 406, as generally described above, but may also place an axial load on the connection sub piston 502 in the opposite direction. Similar to the upper locking mechanism 424*a*, the lower locking mechanism 424*b* may comprise a body lock ring that includes a plurality of ramped teeth 504 defined on its inner radial surface. The connection sub piston 502 may likewise define a plurality of ramped teeth 506 on its outer radial surface, and the ramped teeth 506 of the connection sub piston 502 may be configured to engage the ramped teeth 504 of the lower locking mechanism 424*b* in both the supported and unsupported positions.

The ramped teeth 504, 506 may be angled such that movement of the connection sub piston 502 in the uphole direction (i.e., toward the piston 406) allows the connection sub piston 502 to ratchet in the uphole direction. The ramped teeth 504, 506, however, may be angled such that movement of the connection sub piston 502 in the downhole direction relative to the lower locking mechanism 424*b* is substantially prevented. Accordingly, in the supported position, as shown in FIG. 4B, the engagement between the ramped teeth 504, 506 prevents the connection sub piston 502 from moving in the downhole direction, even upon assuming the axial load derived from the pressure increase in the pressure chamber 419. In moving the connection sub piston 502 to the unsupported position, as shown in FIG. 5, the ramped teeth 506 of the connection sub piston 502 may ratchet against the ramped teeth 504 of the lower locking mechanism 424*b* as the connection sub piston 502 moves in the uphole direction. Once in the unsupported position, the angled engagement of the ramped teeth 504, 506 may then prevent movement of the connection sub piston 502 in the downhole direction.

Those skilled in the art will readily appreciate this advantage. The running tool 200 is prevented from releasing the downhole tool assembly 116 until the torque lock feature is unlocked. Annulus pressure can be applied outside the tool and will not affect the release mechanism until the torque lock is unlocked. The piston abuts and blocks the axial movement of the sub piston 502 while in the torque locked position. The advantage is that annular pressure can be applied without releasing the running tool. For instance, during run-in and before internal pressure is applied, annular pressure can be applied to test position of seals in a seal bore below the downhole tool assembly 116 or activate a valve in the completion below the downhole tool assembly 116, or activate a tool attached to the tool assembly 116, or set another packer. More particularly, during run-in and while the running tool 200 transitions between the torque-locked and torque-released positions, as described above, the connection sub piston 502 may be engaged at the lower locking mechanism 424*b* so that it is prevented from axially moving in the downhole direction with respect to the connection sub 204 or the body 202. This may prove advantageous if the pressure within the interior 402 is inadvertently increased or a pressure spike is unexpectedly experienced, which may act on the connection sub piston 502 via the pressure ports 418. Conventional running tools are often configured to release from the downhole tool assembly 116 (FIGS. 2A-2B) by pressurizing the interior 204, which could be problematic upon assuming unexpected pressure spikes that may result in the premature detachment of the downhole tool assembly 116. The running tool 200 of the present disclosure, however, includes the lower locking mechanism 424*b*, which effectively prevents the running tool 200 from detaching from the downhole tool assembly 116 upon assuming unexpected (or expected) or inadvertent pressure spikes in the interior 402 of the running tool 200.

Rather, to release the running tool 200 from the downhole tool assembly 116, and otherwise move the connection sub piston 502 to the unsupported position, the fluid pressure on the exterior of the running tool 200 may be increased. More particularly, the pressure within the annulus 122 (FIG. 1) defined between the running tool 200 and a wall of the wellbore 106 (FIG. 1) may be increased. Increasing the pressure within the annulus 122 may be facilitated, in at least one embodiment, by setting a packer (not shown) or another type of wellbore isolation device within the annulus 122 below the running tool 200. The pressure increase may then be accomplished by pressurizing the annulus 122 from the surface 104 (FIG. 1) or from an intermediate location in the wellbore 106.

Increasing the pressure outside of the running tool 200 may generate a pressure differential across the running tool 200, and more particularly, across the connection sub piston 502. The pressure differential may serve to move the connection sub piston 502 axially within the piston chamber 408 (i.e., the pressure cavity 419) toward the piston 406 and toward the unsupported position. In some embodiments, however, the connection sub piston 502 may be secured to the collet 206 using one or more shearable devices 508, such as shear pins or shear screws. The shearable devices 508 (two shown) may be configured to shear and otherwise fail upon assuming a predetermined axial load. Increasing the pressure outside of the running tool 200 may generate the pressure differential across the connection sub piston 502, and such a pressure differential may result in an axial load being applied on the connection sub piston 502 in the uphole direction. Further increasing the annulus 122 pressure may correspondingly increase the axial load assumed by the connection sub piston 502 until the predetermined axial load of the shearable devices 508 is met or exceeded. When the predetermined axial load of the shearable devices 508 is met or exceeded, the shear pins/screws may fail and the connection sub piston 502 may then be free from engagement with the connection sub 204 and, therefore, free to move axially with respect to the body 202 and the connection sub 204 to the unsupported position.

As the connection sub piston 502 moves to the unsupported position, as mentioned above, the ramped teeth 506 of the connection sub piston 502 may ratchet against the ramped teeth 504 of the lower locking mechanism 424*b*. Once in the unsupported position, however, the angled engagement of the ramped teeth 504, 506 may prevent movement of the connection sub piston 502 in the downhole direction and otherwise back to the supported position.

With the connection sub piston 502 in the unsupported position, the distal end of the connection sub 204 becomes unsupported. In the illustrated embodiment, the ends of the collet fingers 208 may no longer be radially supported by the connection sub piston 502 upon moving to the unsupported position. As a result, any tension or load applied on the running tool 200 in the uphole direction may result in the collet fingers 208 being able to flex radially inward and ratchet out of engagement with the downhole tool assembly 116 (FIGS. 2A-2B). In such embodiments, the engagement profile 212 defined on the ends of the collet fingers 208 may comprise ramped dogs, lugs, keys, or other ramped geometric features that may allow the collet fingers 208 to flex radially inward and out of engagement with the downhole tool assembly 116 upon assuming an axial load (i.e., tension). With the running tool 200 detached from the downhole tool assembly 116, the running tool 200 may then be pulled out of the wellbore 106 (FIG. 1) and otherwise in the uphole direction on the conveyance 118 (FIG. 1).

Referring now to FIGS. 6A-6F, illustrated are partial cross-sectional side views of exemplary releasable connections 600, shown as releasable connections 600*a*, 600*b*, 600*c*, 600*d*, 600*e*, and 600*f*, respectively, according to one or more embodiments. Like reference numerals used in prior figures correspond to similar components or elements that may not be described again in detail. Any of the releasable connections 600*a-f* may replace the collet 206 of FIGS. 2A-2B, 3A-3B, 4A-4B, and 5, and may otherwise be arranged at the distal end of the connection sub 204. As illustrated, each releasable connection 600*a-f* may facilitate and provide a releasable connection or coupling engagement between the connection sub 204 (and therefore the running tool 200) and the downhole tool assembly 116.

Figure 6A:
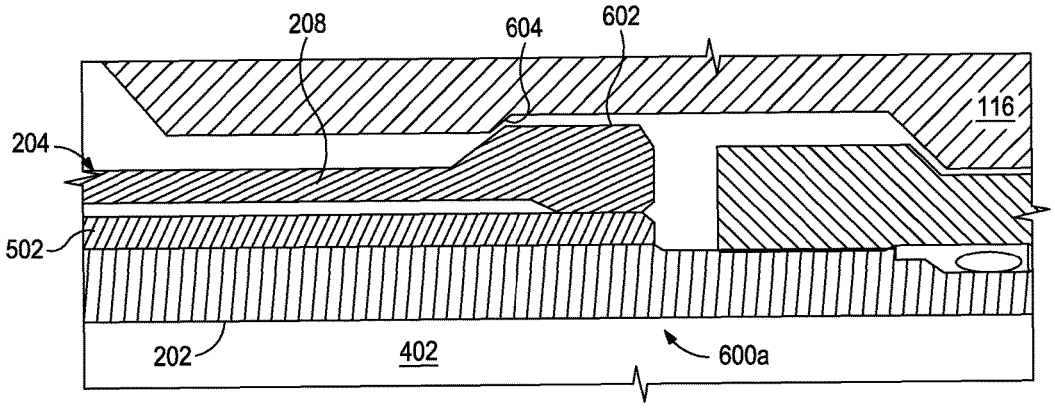
FIGS. 6A-6F are partial cross-sectional side views of exemplary releasable connections.
Figure 6B:
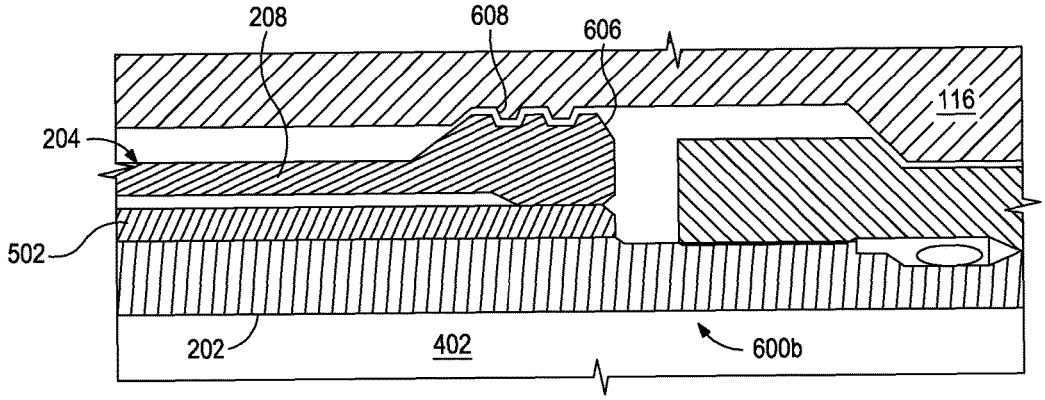

In FIGS. 6A and 6B, the releasable connections 600*a* and 600*b*, respectively, may be substantially similar to the collet 206 of FIGS. 2A-2B, 3A-3B, 4A-4B, and 5. For instance, each releasable connection 600*a,b* may include the plurality of axially extending collet fingers 208 separated by the axially extending slots 210 (not shown). Moreover, each releasable connection 600*a,b* may further include an engagement profile configured to mate with a corresponding engagement profile defined on the inner radial surface of the downhole tool assembly 116. In FIG. 6A, for instance, an engagement profile 602 of the releasable connection 600*a* may comprise a single bump profile configured to engage a corresponding engagement profile 604 defined on the inner radial surface of the downhole tool assembly 116. Moreover, in FIG. 6B, an engagement profile 606 of the releasable connection 600*b* may comprise a multi-bump profile configured to engage a corresponding engagement profile 608 defined on the inner radial surface of the downhole tool assembly 116.

As depicted in FIGS. 6A and 6B, the connection sub 204 is in the supported position, where the connection sub piston 502 radially supports the collet fingers 208. Upon transitioning the connection sub 204 to the unsupported position, however, the connection sub piston 502 is moved axially in the uphole direction (i.e., to the left in FIGS. 6A-6F) so that at least a portion of the collet fingers 208 is no longer radially supported, as generally described above. As a result, any tension or load applied on the running tool 200 in the uphole direction may result in the collet fingers 208 being able to flex radially inward and ratchet the engagement profiles 602, 606 out of engagement with the corresponding engagement profiles 604, 608, respectively. As illustrated, the engagement profiles 602, 606 and the corresponding engagement profiles 604, 608 may provide angled opposing surfaces that help the collet fingers 208 flex radially inward to ratchet out of engagement with the downhole tool assembly 116.

Figure 6C:
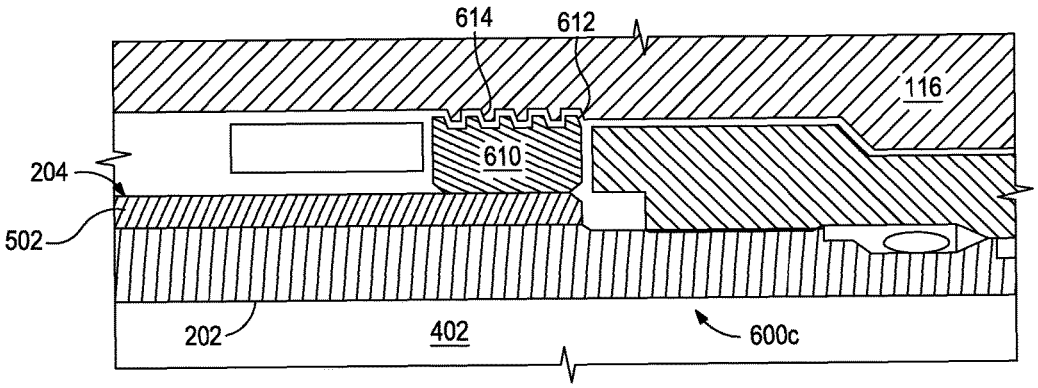
Figure 6D:
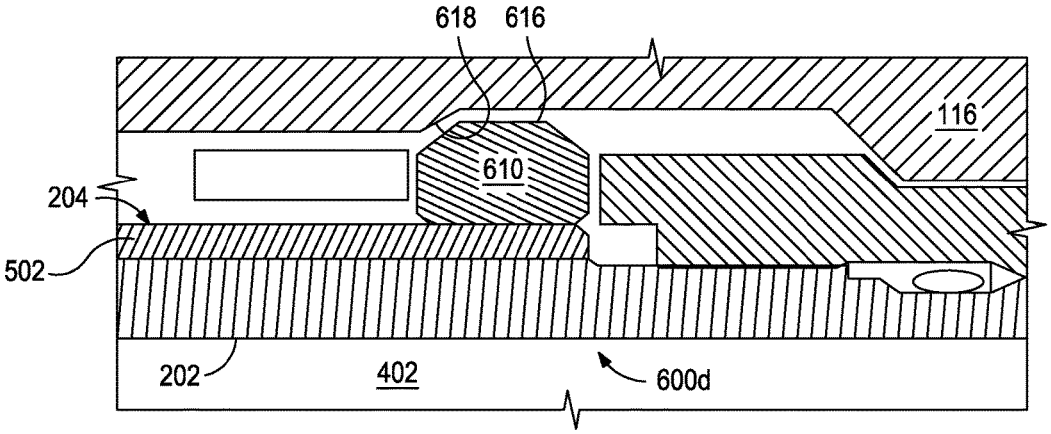
Figure 6E:
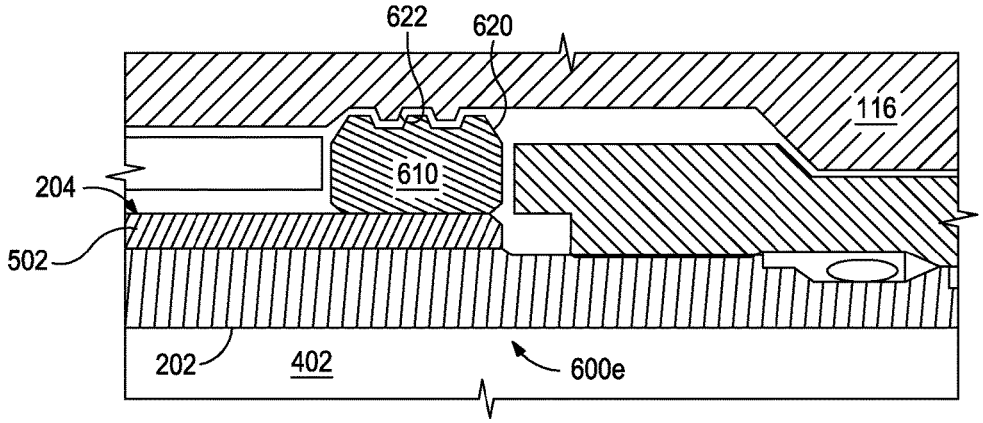

In FIGS. 6C-6E, the releasable connections 600*c*, 600*d*, and 600*e*, respectively, may each include one or more lugs 610 spaced circumferentially about the connection sub 204 and, more particularly, about the distal end of the connection sub piston 502. Each of the lugs 610 may provide an engagement profile on its outer radial surface configured to mate with a corresponding engagement profile defined on the inner radial surface of the downhole tool assembly 116. More particularly, the lugs 610 in FIG. 6C may provide an engagement profile 612 that may comprise radial grooves or threading configured to engage a corresponding engagement profile 614 that may comprise corresponding grooves or threading 614. The lugs 610 in FIG. 6D may provide an engagement profile 616 that may comprise single bump profile configured to engage a corresponding engagement profile 618 that may comprise a radial protrusion defined on the inner radial surface of the downhole tool assembly 116. Lastly, the lugs 610 in FIG. 6E may provide an engagement profile 620 that may comprise a multi-bump profile configured to engage a corresponding engagement profile 622 that may comprise radial protrusions defined on the inner radial surface of the downhole tool assembly 116.

As depicted in FIGS. 6C-6E, the connection sub 204 is in the supported position, where the connection sub piston 502 radially supports the lugs 610. Upon transitioning the connection sub 204 to the unsupported position, however, the connection sub piston 502 is moved axially in the uphole direction so that the lugs 610 are no longer radially supported. As a result, any tension or load applied on the running tool 200 in the uphole direction may result in the lugs 610 being able to fall or move radially inward and out of engagement with the downhole tool assembly 116. In FIG. 6C, the lugs 610 may alternatively be able to be unthreaded from the corresponding engagement profile 614.

Figure 6F:
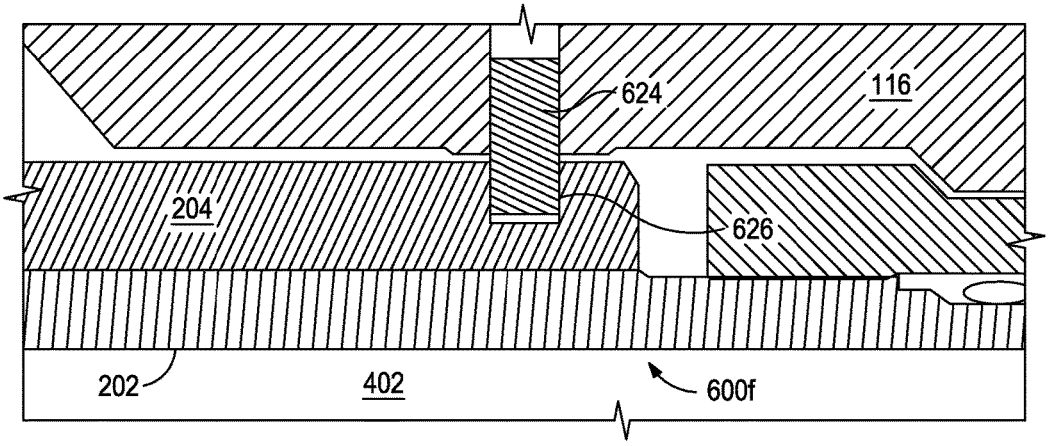

In FIG. 6F, the releasable connections 600*f* may include one or more shearable devices 624 that couple the downhole tool assembly to the connection sub 204. The connection sub 204 is depicted in FIG. 6F in the supported position, where the shearable devices 624 are intact and received within corresponding holes 626 defined in the connection sub 204. Upon transitioning the connection sub 204 to the unsupported position, however, the shearable devices 624 will fail and otherwise be sheared, and thereby detaching the connection sub 204, and therefore the running tool 200, from the downhole tool assembly 116.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A system, comprising:

a downhole tool assembly extendable within a wellbore on a conveyance and having at least one axial extension; and a running tool axially interposing the downhole tool assembly and the conveyance and including:

an elongate body providing an interior and one or more radial protrusions;

a connection sub disposed about the body and providing a releasable connection engageable with the downhole tool assembly;

a torque sleeve disposed about the body and at least a portion of the connection sub, the torque sleeve defining at least one arcuate cutout for receiving the at least one axial extension; and a connection sub piston interposing the body and the connection sub and being axially movable between a supported position, where the connection sub piston radially supports the connection sub, and an unsupported position, where at least a portion of the connection sub is radially unsupported by the connection sub piston, wherein increasing a pressure within an annulus defined between the running tool and a wall of the wellbore moves the connection sub piston from the supported position to the unsupported position.

2. The system of claim 1, wherein the releasable connection comprises:

a collet providing a plurality of axially extending collet fingers separated by axially extending slots that receive the one or more radial protrusions; and an engagement profile defined on each collet finger and being matable with an inner radial surface of the downhole tool assembly, wherein, when the connection sub piston is in the unsupported position, the collet fingers can flex radially inward and out of engagement with the downhole tool assembly, and thereby detach the running tool from the downhole tool assembly.

3. The system of claim 1, wherein the releasable connection comprises:

one or more lugs spaced circumferentially about the connection sub piston; and an engagement profile defined on each lug and being matable with an inner radial surface of the downhole tool assembly, wherein, when the connection sub piston is in the unsupported position, the one or more lugs can move radially inward and out of engagement with the downhole tool assembly, and thereby detach the running tool from the downhole tool assembly.

4. The system of claim 1, wherein the releasable connection comprises one or more shearable devices that couple the downhole tool assembly to the connection sub.

5. The system of claim 1, further comprising:

a housing cylinder disposed at least partially about the connection sub piston; and a lower locking mechanism positioned between the connection sub piston and the housing cylinder, the lower locking mechanism having a plurality of ramped teeth defined on an inner radial surface and engageable with a plurality of ramped teeth defined on an outer radial surface of the connection sub piston, wherein engagement between the plurality of ramped teeth of the lower locking mechanism and the connection sub piston prevent the connection sub piston from axially moving in a downhole direction with respect to the lower locking mechanism.

6. The system of claim 5, wherein engagement between the pluralities of ramped teeth of the lower locking mechanism and the connection sub piston secure the connection sub piston in the unsupported position.

7. The system of claim 1, further comprising:

a housing cylinder disposed about the body and positioned at least partially between the body and the torque sleeve;

a piston interposing the body and the housing cylinder and axially movable within a piston chamber cooperatively defined by the body and the housing cylinder; and one or more pins extending between the torque sleeve and the piston through a corresponding one or more axial slots defined in the housing cylinder, wherein the one or more pins operatively couple the piston to the torque sleeve such that axial movement of the piston correspondingly moves the torque sleeve, wherein the piston is movable between a torque-locked position, where the at least one axial extension is received within the at least one arcuate cutout and the running tool is thereby prevented from rotating relative to the downhole tool assembly, and a torque-released position, where the torque sleeve is moved axially to disengage the at least one axial extension from the at least one arcuate cutout and thereby allowing the running tool to be rotated relative to the downhole tool assembly.

8. The system of claim 7, wherein, when the piston is in the torque-released position, rotating the running tool relative to the downhole tool assembly detaches the downhole tool assembly from the running tool.

9. The system of claim 7, further comprising:

a pressure cavity forming part of the piston chamber downhole from the piston; and one or more pressure ports defined in the body to facilitate fluid communication between the interior and the pressure cavity, wherein the piston is moveable to the torque-released position by an increased fluid pressure within the interior, corresponding to an increased fluid pressure within the pressure cavity and an axial load placed on the piston to move the piston within the piston chamber to the torque-released position.

10. The system of claim 7, further comprising:

a plurality of splines defined on an outer radial surface of the connection sub; and a splined profile defined on an inner radial surface of the torque sleeve and matable with the plurality of splines, wherein, when the piston is in the torque-locked position, torque is transferred from the connection sub to the torque sleeve via engagement between the plurality of splines and the splined profile.

11. The system of claim 7, further comprising:

an upper locking mechanism disposed between the piston and the housing cylinder and including a plurality of ramped teeth defined on an inner radial surface; and a plurality of ramped teeth defined on an outer radial surface of the piston to engage the plurality of ramped teeth of the upper locking mechanism as the piston moves toward the torque-released position, wherein the pluralities of ramped teeth of the upper locking mechanism and the piston are angled to allow movement of the piston to the torque-released position, but prevent the piston from moving back to the torque-locked position.

12. A method, comprising:

introducing a downhole tool assembly into a wellbore, the downhole tool assembly having at least one axial extension and being coupled to a running tool attached to a conveyance, the running tool including:

an elongate body providing an interior and one or more radial protrusions;

a connection sub disposed about the body and providing a releasable connection engageable with the downhole tool assembly;

a torque sleeve disposed about the body and at least a portion of the connection sub, the torque sleeve defining at least one arcuate cutout for receiving the at least one axial extension; and a connection sub piston interposing the body and the connection sub and being axially movable between a supported position, where the connection sub piston radially supports the connection sub, and an unsupported position, where at least a portion of the connection sub are radially unsupported by the connection sub piston;

increasing a pressure within an annulus defined between the running tool and a wall of the wellbore and thereby moving the connection sub piston from the supported position to the unsupported position; and placing a tensile load on the running tool and thereby detaching the running tool from the downhole tool assembly.

13. The method of claim 12, wherein the running tool further includes a piston interposing the body and a housing cylinder and axially movable within a piston chamber cooperatively defined by the body and the housing cylinder the method further comprising:

moving the piston between a torque-locked position, where the at least one axial extension is received within the at least one arcuate cutout and the running tool is thereby prevented from rotating relative to the downhole tool assembly, and a torque-released position, where the torque sleeve is moved axially to disengage the at least one axial extension from the at least one arcuate cutout and thereby allowing the running tool to be rotated relative to the downhole tool assembly.

14. The method of claim 13, wherein the running tool further includes a pressure cavity forming part of the piston chamber downhole from the piston, and one or more pressure ports are defined in the body to facilitate fluid communication between the interior and the pressure cavity, the method further comprising:

increasing a fluid pressure within the interior and thereby increasing a fluid pressure within the pressure cavity; and placing an axial load on the piston with the fluid pressure in the pressure cavity and thereby moving the piston within the piston chamber to the torque-released position.

15. The method of claim 12, wherein the releasable connection includes a collet providing a plurality of axially extending collet fingers and having an engagement profile defined on each collet finger and being matable with an inner radial surface of the downhole tool assembly, and wherein placing the tensile load on the running tool comprises flexing the collet fingers radially inward and out of engagement with the downhole tool assembly.

16. The method of claim 15, wherein the engagement profile comprises threading, the method further comprising rotating the running tool relative to the downhole tool assembly with the piston in a torque-released position and thereby detaching the downhole tool assembly from the running tool.

17. The method of claim 12, wherein the releasable connection includes one or more lugs spaced circumferentially about the connection sub piston and an engagement profile defined on each lug and being matable with an inner radial surface of the downhole tool assembly, and wherein placing the tensile load on the running tool comprises moving the one or more lugs radially inward and out of engagement with the downhole tool assembly.

18. The method of claim 12, wherein the releasable connection includes one or more shearable devices that couple the downhole tool assembly to the connection sub, and wherein placing the tensile load on the running tool comprises shearing the one or more shearable devices.

19. A running tool, comprising:

an elongate body providing an interior and one or more radial protrusions;

a connection sub disposed about the body and providing a releasable connection engageable with a downhole tool assembly;

a torque sleeve disposed about the body and at least a portion of the connection sub, the torque sleeve defining at least one arcuate cutout for receiving a corresponding at least one axial extension of a downhole tool assembly;

a connection sub piston interposing the body and the connection sub and being axially movable between a supported position, where the connection sub piston radially supports the connection sub, and an unsupported position, where at least a portion of the connection sub are radially unsupported;

a housing cylinder disposed about the body and positioned at least partially between the body and the torque sleeve;

a piston interposing the body and the housing cylinder and axially movable within a piston chamber cooperatively defined by the body and the housing cylinder; and one or more torque pins extending between the torque sleeve and the piston through a corresponding one or more axial slots defined in the housing cylinder, wherein the one or more torque pins operatively couple the piston to the torque sleeve such that axial movement of the piston correspondingly moves the torque sleeve.

20. The running tool of claim 19, wherein the piston is movable between a torque-locked position, where the at least one axial extension is received within the at least one arcuate cutout and the running tool is thereby prevented from rotating relative to the downhole tool assembly, and a torque-released position, where the torque sleeve is moved axially to disengage the at least one axial extension from the at least one arcuate cutout and thereby allow the running tool to be rotated relative to the downhole tool assembly.

21. The running tool of claim 20, wherein the releasable connection is threaded to the downhole tool assembly, and wherein, when the piston is in the torque-released position, rotating the running tool relative to the downhole tool assembly detaches the downhole tool assembly from the running tool.

22. The running tool of claim 19, wherein the connection sub piston is moved from the supported position to the unsupported position by increasing a pressure within an annulus defined between the running tool and a wall of a wellbore, and wherein, when the connection sub piston is in the unsupported position, the releasable connection can disengage from the downhole tool assembly and thereby detach the running tool from the downhole tool assembly.

* * * * *